US006421849B1

(12) United States Patent
Gray

(10) Patent No.: US 6,421,849 B1
(45) Date of Patent: Jul. 23, 2002

(54) MOUNTING ASSEMBLY FOR PLUMBING CONTROL FITTING

(75) Inventor: Ricardo O. Gray, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/912,826

(22) Filed: Jul. 25, 2001

(51) Int. Cl.[7] ..... E03C 1/042
(52) U.S. Cl. ..... 4/675; 4/695; 137/360
(58) Field of Search ..... 4/675, 678, 695, 4/696, DIG. 7; 137/801, 359, 360

(56) References Cited

U.S. PATENT DOCUMENTS

| | | | | |
|---|---|---|---|---|
| 2,708,449 A | * | 5/1955 | Keithley | |
| 4,186,761 A | * | 2/1980 | Guarnieri | 4/695 |
| 4,281,857 A | * | 8/1981 | Randall | |
| 4,502,165 A | | 3/1985 | Szemeredi et al. | |
| 4,852,192 A | * | 8/1989 | Viegener | |
| 5,135,022 A | * | 8/1992 | Kovey et al. | |
| 5,381,830 A | * | 1/1995 | Niemann et al. | |
| 5,465,749 A | | 11/1995 | Sauter et al. | |
| 5,515,882 A | | 5/1996 | Hennis | |
| 5,946,746 A | | 9/1999 | Bloom | |

FOREIGN PATENT DOCUMENTS

| | | | | |
|---|---|---|---|---|
| DE | 3231214 A | * | 2/1984 | 4/696 |
| DE | 3830201 A | * | 3/1990 | 4/675 |
| DE | 4241886 A | * | 6/1993 | 4/695 |

* cited by examiner

*Primary Examiner*—Charles R. Eloshway
(74) *Attorney, Agent, or Firm*—Quarles & Brady LLP

(57) ABSTRACT

An assembly for mounting a faucet, plumbing control valve, or other plumbing fitting on a counter top or other wall is disclosed. The fitting includes an externally threaded housing (e.g. the exterior of a conduit or valve cartridge). The fitting is mounted by a wedge lock adapter that includes a cage and a ring nut. The cage has an annular base sized smaller than the mounting opening in the wall, and three wedge-shaped legs. The legs extend upwardly from the base through the opening to upper feet extending radially outward beyond the diameter of the mounting opening. The ring nut is captured in the cage and has an annular body with a threaded inner diameter that engages the external threads of the valve body. The ring nut has three tabs extending radially outward between the legs such that the fitting can be secured by rotating the fitting to drive the ring up, and thereby drive the legs outward against the inner diameter of the mounting opening.

6 Claims, 3 Drawing Sheets

MOUNTING ASSEMBLY FOR PLUMBING CONTROL FITTING

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to plumbing control fittings such as faucets and shower controls. In particular it relates to assemblies for mounting them on counter tops, sinks or vertical walls, without the need for access to the unexposed side of the walls.

Conventional faucet fixtures often require the installer to connect the components of the assembly from beneath the sink, typically in cramped, dark spaces. See e.g. U.S. Pat. No. 4,502,165.

Faucet fixtures that can to a greater extent be assembled from above a counter top have been developed. See e.g. U.S. Pat. Nos. 5,465,749 and 5,946,746. A drawback of these assemblies is that they are features of the faucet fixtures, thus requiring somewhat complicated manufacturing processes, and rendering them unsuitable for retrofitting existing faucets.

Another top mounted faucet installation assembly is disclosed in U.S. Pat. No. 5,515,882. It includes a spring member mounted to a threaded rod that can be inserted through mounting opening(s) from above the counter top or sink deck. The spring has upper shoulders that can engage the underside of a counter top or sink deck to secure the fixture in place. The spring is raised or lowered by rotation of a nut along the threaded rod. This system is disadvantageous because the nut for tightening the spring must be worked from below the sink.

An improved mounting system for plumbing control valves is therefore desired.

SUMMARY OF THE INVENTION

In one aspect the invention provides an assembly for mounting a plumbing control fitting to a wall. The wall is of the type having a mounting opening there through (e.g. a counter top, a sink basin wall, a shower enclosure side wall). The assembly has a fitting having an externally threaded outer housing, an elevator cage having a base and at least two flexible legs extending axially from the base to feet that extend radially outwardly, and a nut positioned within the cage having an annular body with a threaded inner diameter engaging the external threads of the fitting. The nut has a tab extending radially outwardly between the legs. Rotation of the fitting about its longitudinal axis can drive the nut axially along the fitting and thereby drive the legs radially outwardly.

The elevator cage can further include a third leg extending axially from the base. The three legs are preferably substantially evenly circumferentially spaced around the base. If desired the outward surfaces of the legs can be substantially co-cylindrical with the outer diameter of the base and an outer surface of a leg can have teeth. Contact between the tab and a leg can limit rotation of the nut.

In yet another aspect the invention provides an assembly for mounting a plumbing control fitting having an externally threaded housing to a wall, the wall being of the type having a mounting opening there through. The assembly has an elevator cage having a base and at least two flexible legs extending axially from the base to feet that extend radially outwardly. A nut is positioned within the cage having an annular body with a threaded inner diameter suitable to engage the external threads of the fitting. The nut has a tab extending radially outwardly between the legs. Rotation of the fitting about its longitudinal axis (if the assembly is used to mount the fitting on the wall) can drive the nut axially along the fitting and thereby drive the legs radially outwardly.

The fitting can be a cartridge for a control valve, or it can be a tubular extension from a faucet or the like, or it can be some other fitting housing element with external threads. The cage will typically have a central hole through its base. However, it need not have this feature if the fitting element is small.

The invention thus provides a mounting assembly that can be attached to a counter top, sink basin, or vertical wall without requiring access to the underside/inside of the wall/top/basin. The fitting can be assembled or disassembled quickly. The device works by driving legs of a cage outward. In counter top installations, the axial direction will typically be vertical. In vertical wall mounted installations, it will be horizontal.

The elevator cage has an annular base sized smaller than the mounting opening. The nut, preferably in the shape of a ring with a tab, is captured within the cage. As it rides up on the fitting, it is limited in rotation by the tab/leg interaction, and thus drives the inwardly bent legs outward.

The ring and cage components of the attachment assembly can be manufactured separate from the faucet fixture. They can be sold separate from the faucet fixture (in place of the usual under counter nut), as a retrofit kit.

These and still other advantages of the invention will be apparent from the detailed description and drawings.

DETAILED DESCRIPTION OF THE PREFERRED EMBODIMENT

Figure 1:
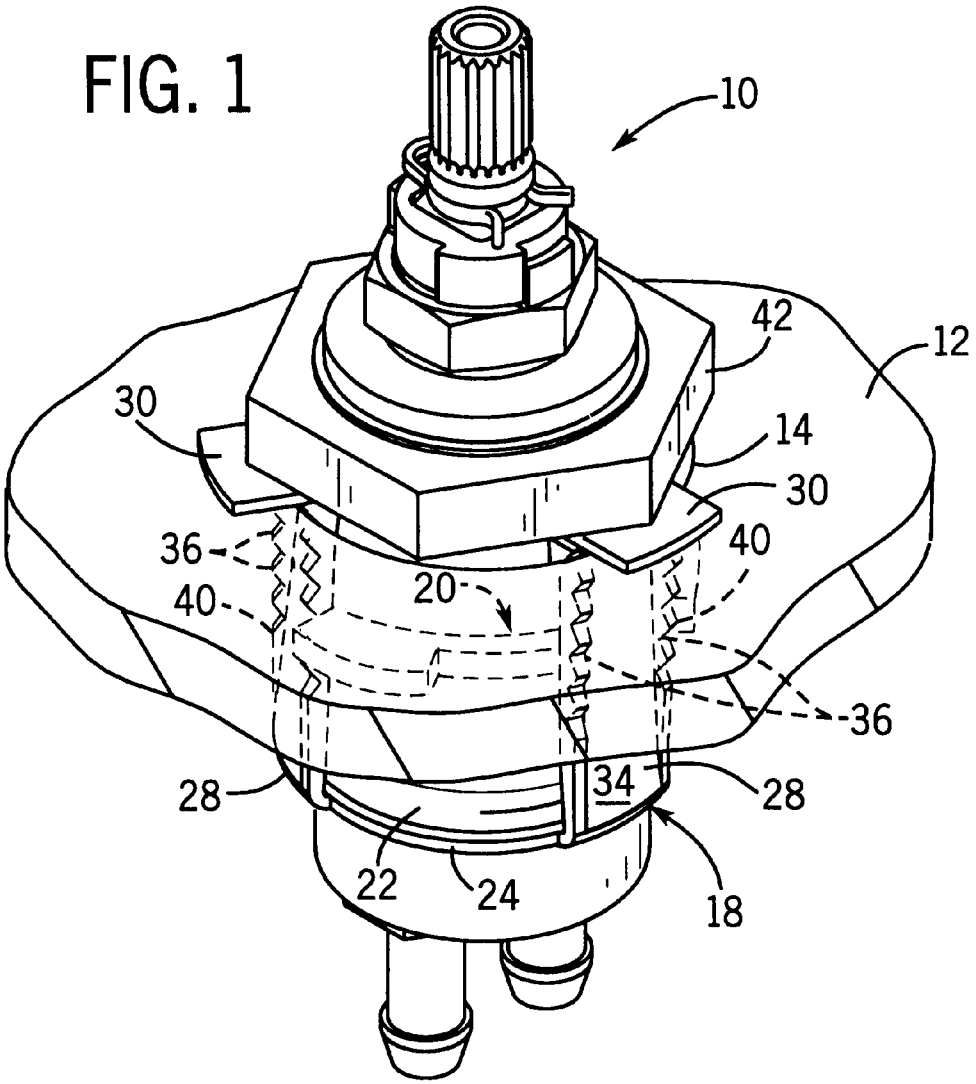
FIG. 1 is a perspective view of a preferred embodiment of the present invention.
Figure 2:
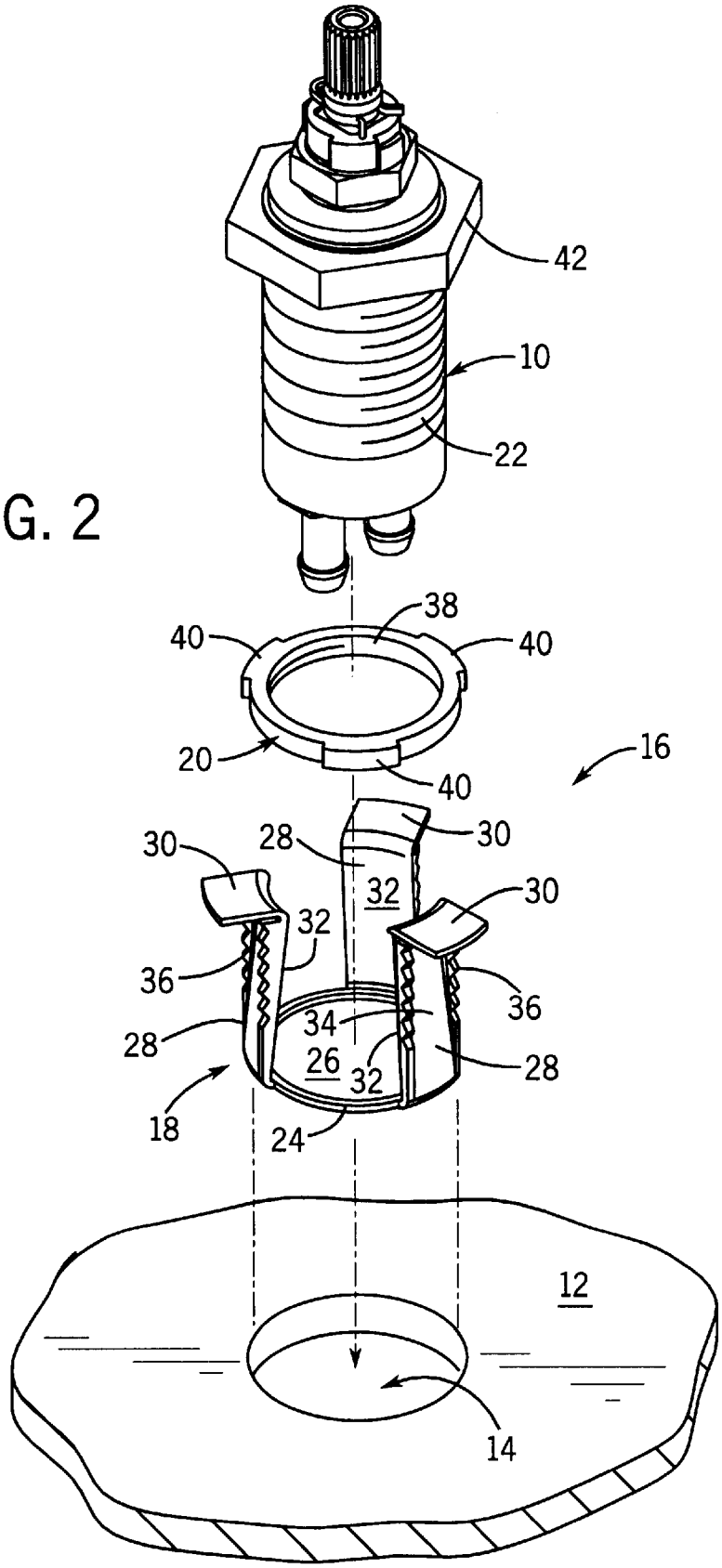
FIG. 2 is an exploded perspective view thereof.

Referring first to FIGS. 1 and 2, a valve body/fitting 10 is mounted to a counter top/sink deck 12 at an opening 14 by a wedge lock attachment assembly 16. The assembly 16 includes an "elevator" cage 18 and a ring nut 20.

There is a housing on the fitting with external threads 22. The elevator cage 18 has a washer-shaped annular base 24 with a central opening 26 sized so that the bottom end of the valve body 10 can pass there through. Spaced around the base 24 are three legs 28 extending upwardly to upper feet 30 that are directed radially outward.

The legs 28 are wedge-shaped having inner arcuate surfaces 32 tapering inwardly from the base 24 to the upper feet 30. Outer surfaces 34 of the legs 28 are generally co-cylindrical with the outer diameter of the base 24, which is sized smaller than the diameter of the mounting opening 14. The attachment assembly 16 can be manufactured in a range of standard sizes to accommodate various mounting opening diameters.

Outside edges of upper portions of the outer surfaces 34 (adjacent the upper ends 30) have teeth 36 for gripping the inner diameter of the mounting opening 14. The legs 28 of the elevator cage 18 are preset with a slight inward bend (see FIG. 3) and are designed to flex or deflect radially outward in response to tightening of the ring nut 20 upward on the valve body 10 inside cage 18.

The ring nut 20 is a washer-like annular body, preferably made of brass, having an internally threaded center opening 38 sized to mate with threads 22 of the valve body 10, and the three tabs 40 extend radially outward. The ring nut 20 is sized to fit loosely within the cage 18 near the base 24. However, it is larger than the inner diameter defined by upper portions of the legs 28. The tabs 40 extend between legs 28.

Figure 3:
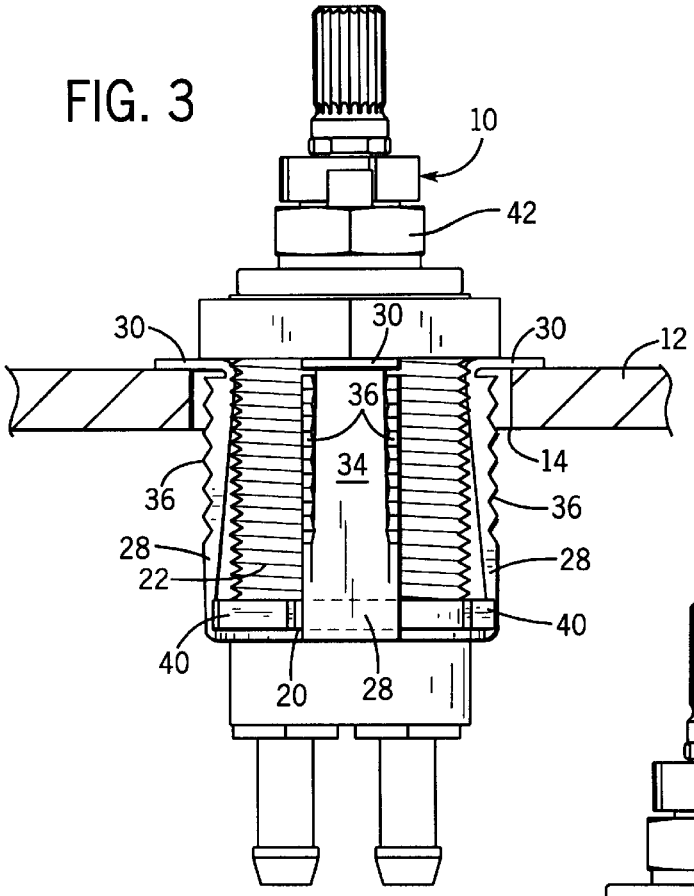
FIG. 3 is a front elevational view, partially in section, showing the ring nut in its lower, non-locking position.

Referring now to FIG. 3, with the ring nut 20 disposed in the cage 18 and threaded to the valve body 10, the valve body 10 (and thus the faucet fixture) can be mounted to the counter top or sink deck 12 from above. One drops the valve body 10 and the attachment assembly 16 into the mounting opening 14 until the upper feet 30 rest on the top surface of the counter or deck. The upper feet 30 can support the valve body 10 in the mounting opening 14 until it is ready to be fastened in place.

Figure 4:
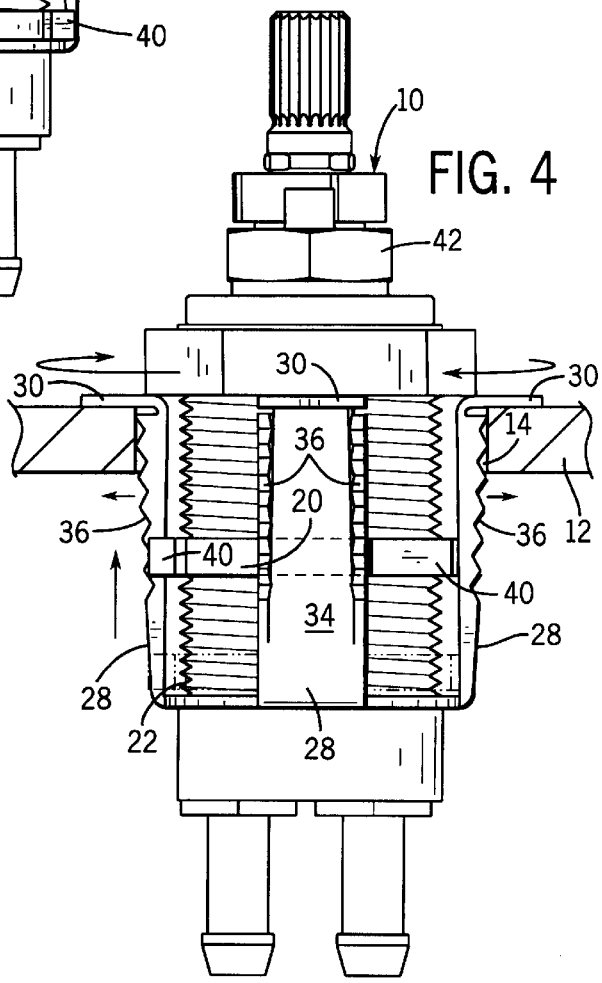
FIG. 4 is a view similar to FIG. 3, albeit with the ring nut shown in its upper, locking position.

Before the valve body 10 is tightened in place, the ring nut 20 (threaded to the valve body 10) will rest on or near the base 24 of the cage 18. As can be seen from comparing FIGS. 3 and 4, the valve body 10 is secured by rotating the valve body 10 clockwise, initially by hand and then by a wrench fit onto a hex region 42 of the valve body 10. As the valve body 10 is rotated, the external threads 22 engage the internally threaded opening 38 of the ring nut 20 so that it rotates until the tabs 40 come in contact with edges of the legs 28.

Further clockwise rotation of the valve body 10 causes the ring nut 20 to translate upwardly along the legs 28, and ultimately push all three of the wedge-shaped legs 28 outwardly. This causes the teeth 36 of the legs 28 to abut, and be biased against, the inner diameter of the mounting opening 14.

the valve body 10 is tightened further, the teeth 36 of the legs 28 will engage and thread into the mounting opening 14, thereby, making a secure connection with the counter top or sink deck. The force applied by the legs 28 against the mounting opening 14 is all that is need to secure the valve body 10 in place. The ring nut 20 does not need to contact the underside of the counter top or sink deck to achieve this connection. The remaining components of the faucet fixture can then be assembled to the valve body 10 from above the sink. If desired, the water lines can be pre-assembled with the fitting. Alternatively, they can be connected below the sink in the usual fashion after the fitting has been mounted.

The invention provide a valve fixture that can be easily secured in place from above a counter top or sink ledge (or outside a vertical wall) in a wide range of mounting hole diameters. The attachment assembly includes a small number of components, making the installation simple and the assembly inexpensive to manufacture.

It should be appreciated that a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

Industrial Applicability

The invention provides assemblies for mounting plumbing fittings to mounting surfaces.

I claim:

1. An assembly for mounting a plumbing control fitting to a wall, the wall being of the type having a mounting opening there through, the assembly comprising:

a fitting having an externally threaded outer housing;

an elevator cage having a base and at least two flexible legs extending axially from the base to feet that extend radially outwardly; and a nut positioned within the cage having an annular body with a threaded inner perimeter engaging the external threads of the fitting, the nut having a tab extending radially outwardly between the legs;

wherein rotation of the fitting in one direction about its longitudinal axis drives the nut axially along the fitting and thereby drives the legs radially outwardly.

2. The assembly of claim 1, wherein the elevator cage further comprises a third leg extending axially from the base, wherein the three legs are substantially evenly circumferentially spaced around the base.

3. The assembly of claim 2, wherein the outward surfaces of the legs are substantially co-cylindrical with the outer diameter of the base.

4. The assembly of claim 3, wherein an outer surface of a leg has teeth.

5. The assembly of claim 1, wherein contact between the tab and a leg limits rotation of the nut.

6. An assembly for mounting a plumbing control fitting having an externally threaded housing to a wall, the wall being of the type having a mounting opening there through, the assembly comprising:

an elevator cage having a base and at least two flexible legs extending axially from the base to feet that extend radially outwardly; and a nut positioned within the cage having an annular body with a threaded inner perimeter suitable to engage the external threads of the fitting, the nut having a tab extending radially outwardly between the legs;

wherein rotation of the fitting in one direction about its longitudinal axis drives the nut axially along the fitting and thereby drives the legs radially outwardly.

* * * * *